United States Patent [19]

Toda et al.

[11] Patent Number: 4,794,357

[45] Date of Patent: Dec. 27, 1988

[54] MULTI-POLE CIRCUIT INTERRUPTER

[75] Inventors: Haruhisa Toda; Shiroo Murata; Hiroaki Fujihisa, all of Fukuyama, Japan

[73] Assignee: Mitsubishi Denki Kabushiki Kaisha, Japan

[21] Appl. No.: 79,460

[22] Filed: Jul. 30, 1987

[30] Foreign Application Priority Data

Aug. 4, 1986 [JP] Japan ..... 61-120175[U]
Aug. 4, 1986 [JP] Japan ..... 61-120176[U]

[51] Int. Cl.[4] ..... H01H 75/00
[52] U.S. Cl. ..... 335/46; 200/144 R
[58] Field of Search ..... 200/146 R, 144 R; 335/46

[56] References Cited

U.S. PATENT DOCUMENTS 3,492,609 1/1970 Murai et al. ..... 335/16
4,227,161 10/1980 Yamat et al. ..... 335/16
4,626,811 12/1986 McKee et al. ..... 335/46

*Primary Examiner*—Robert S. Macon
*Attorney, Agent, or Firm*—Leydig, Voit & Mayer

[57] ABSTRACT

A multi-pole circuit interrupter having a first pole unit provided with an operating mechanism and a second pole unit provided with no operating mechanism for interrupting current flowing therethrough by separating a movable contact from a stationary contact as a result of an electromagnetic repulsive force generated upon occurrence of a large overcurrent irresepective of the automatic trip operation of an operating mechanism. Each of the pole units of the circuit interrupter comprises a contact arm assembly for supporting the movable contact including a first contact arm and a second contact arm pivotally supported by a common pivot pin. The first contact arm in the first pole unit has an elongated guide hole extending in a direction of movement of the movable contact and is directly connected to the operating mechanism. The first contact arm in the second pole unit is connected to the operating mechanism through a cross bar. The second contact arm has an elongated hole extending substantially in a direction of extension thereof. A spring-biased sliding pin extends through the elongated hole and the guide hole, and a stopper is mounted to a base of the second pole unit for limiting movement of the second contact arm beyond a predetermined position.

2 Claims, 10 Drawing Sheets

MULTI-POLE CIRCUIT INTERRUPTER

BACKGROUND OF THE INVENTION

This invention relates to a multi-pole circuit interrupter in which a first pole unit with an operating mechanism and a second pole unit without an operating mechanism are provided and in which a movable contact is moved to open by an electromagnetic repulsive force resulting from a large current irrespective of the interrupting operation by an automatic trip mechanism.

A conventional circuit interrupter to which the present invention pertains will be described in conjunction with FIGS. 1 to 8. FIG. 1 is a plan view of a conventional multi-pole circuit interrupter; FIG. 2 is an enlarged cross sectional view taken along line II—II of FIG. 1; FIG. 3 is a partial enlarged sectional view of FIG. 2 showing the ON position; FIG. 4 is a view similar to FIG. 3, but illustrating the OFF position; FIG. 5 is a view similar to FIG. 3, but illustrating the TRIP position; FIG. 6 is a view similar to FIG. 3, but illustrating the electromagnetically operated position; FIG. 7 is an enlarged cross sectional view taken along line VII—VII of FIG. 1 illustrating the ON position; and FIG. 8 is an enlarged view of a portion of FIG. 7 but illustrating the OFF position.

In FIG. 1, the multi-pole circuit interrupter is illustrated as having a housing 1 in which a central first pole unit 2 provided with an operating mechanism is positioned between a pair of side second pole units 3 being provided with no operating mechanism. The first pole unit 2 has formed therein a window 5 through which an operating handle 4 of the operating mechanism extends.

In FIGS. 2 to 6, which illustrate detailed arrangements of the first pole unit 2 in various operating positions, the electrically insulating housing 1 includes a base 1*a* and a cover 1*b*. A stationary source side conductor 6 is mounted on the base 1*a* and has a stationary contact 7 secured thereon. An automatic trip unit 8 is mounted in the housing 1, and a load side conductor 9 is electrically connected to the automatic trip unit 8. A movable contact 10 is secured to a movable member 11 which is electrically connected to the automatic trip unit 8 through a flexible conductor 12 and a connector 13. The movable member 11 is supported by a contact arm assembly 14 comprising a first contact arm 14*a* connected to an operating mechanism 23 which will be described in more detail later, and a second contact arm 14*b* on which the movable member 11 is pivotally supported by a first pin 15. The first contact arms 14*a* for all of the pole units 2 and 3 are also connected to a cross bar 17 for the simultaneous movement of the pole units 2 and 3. The first contact arm 14*a* and the second contact arm 14*b* are pivotally supported independently within the housing by a pivot pin 16.

The first contact arm 14*a* has formed therein a first guide hole 18 extending substantially in a direction of movement of the first contact arm 14*a*. The second contact arm 14*b* has formed therein a second elongated guide hole 19 extending in a direction of extension of the second contact arm 14*b*. A pin 20 extends through the first and the second guide holes 18 and 19 to limit the relative pivotal movement between the first and second contact arms 14*a* and 14*b*. The pin 20 is biased toward a free end of the second contact contact arm 14*b* by a tension spring 21 mounted between the pin 20 and a pin 15 pivotally connecting the movable member 11 to the second contact arm 14*b*. In order to provide a contact biasing force between the movable and stationary contacts 10 and 7, a contact pressure spring 22 is disposed between the movable member 11 and the second contact arm 14*b*. An operating handle 4 is connected to an operating mechanism 23 comprising a releasable cradle 23*a* having a stop pin 24 and a pair of toggle links 23*b* and 23*c* connected between the cradle 23*a* and the first contact arm 14*a* by pivot pins 25*a* and 25*b*. As is well known, an arc extinguisher 26 is disposed in such a way as to extinguish the arc generated between the separated contacts 7 and 10 when they are separated. In FIGS. 7 and 8, which illustrate detailed arrangements of the second pole unit 3 in ON and OFF operating positions, the cover 1*b* of the housing 1 is integrally provided with a stopper 27 for limiting the movement of the second contact arm 14*b*.

When the first pole unit 2 with the operating mechanism 23 of the circuit interrupter is in the ON position shown in FIGS. 2 and 3, an electric current flows from the source side stationary conductor 6 to a load side conductor 9 through the statonary contact 7, the movable contact 10, the movable member 11, the flexible conductor 12, the connector 13 and the automatic trip unit 8 in the named order. When the second pole unit 3 without the operating mechanism 23 is in the ON position shown in FIG. 7, the electric current flows from the source side stationary conductor 6 to the load side conductor 9 through the stationary contact 7, the movable contact 10, the movable member 11, the flexible conductor 12, and the connector 13 in the named order. When the operating handle 4 is moved into the OFF position as shown by an arrow 28 of FIG. 3, the contact arm assembly 14 is lifted by the operating mechanism 23 so that the movable contact 10 together with the movable member 11 is moved away from the stationary contact 7 as shown in FIG. 4 to open the contacts 7 and 10. At this time, since the second pin 20 is positioned in the recessed portion 18*a* of the guide hole 18 due to the biasing function of the tension spring 21, the second contact arm 14*b* is rotated about the pivot pin 16 in the opening direction by the operating mechanism 23 together with the first contact arm 14*a* until it abuts against the stop pin 24. This movement of the contact arm assembly 14 of the first pole unit 2 with the operating mechanism is transmitted through the cross bar 17 to the second pole unit 3 without the operating mechanism so that the contact arm assembly 14 therein opens until the second contact arm 14*b* of the pole unit abuts the stopper 27 mounted on the cover 1*b*.

In the ON position shown in FIGS. 2, 3 and 7, when an overload current flows through the circuit interrupter, the automatic trip unit 8 is actuated to release the cradle 23*a* of the operating mechanism 23 to allow it to rotate in the direction of an arrow 29 of FIG. 3. Then, the toggle links 23*b* and 23*c* of the operating mechanism 23 rotate the contact arm assemby 14 in the clockwise direction in the figure to separate the movable contact 10 from the stationary contact 7, thereby interrupting the overload current. This is the so-called tripped position shown in FIG. 5. During this operation, since the sliding pin 20 is positioned within the recessed portion 18*a* of the guide hole 18 due to the action of the tension spring 21 similarly to the OFF position shown in FIG. 4, the second contact arm 14*b* is rotated clockwise about the pivot shaft 16 by the operating mechanism 23 together with the first contact arm 14*a* until it abuts against the stop pin 24. Although not illustrated, the contact arm assembly 14 in the second pole unit 3 is also separated because of the movement of the cross bar 17 until the second contact arm 14*b* abuts the stopper 27 on the cover 1*b* of the housing in a manner similar to that previously described.

When a large current such as a short-circuit current flows through the circuit interrupter in the ON position shown in FIGS. 2, 3, and 7 an electromagnetic repulsive force generated between the stationary conductor 6 and the movable member 11 causes the movable member 11 to immediately separate from the stationary conductor 6 as shown in FIG. 6. At this time, since the operating mechanism 23 does not allow the first contact arm 14*a* to be actuated because it has not yet been actuated itself, the second contact arm 14*b* rotates clockwise about the pivot pin 16 by moving the sliding pin 20 against the spring force of the tension spring 21 from the recessed portion 18*a* along a pin sliding surface 18*c* in the guide hole 18 until it abuts against an end portion 18*b* of the guide hole 18 as shown in FIG. 6. In the second pole unit 3, in which no operating mechanism is provided, the movable member 11 also moves in the opening direction due to the repulsive force, as shown in FIG. 8, until the sliding pin 20 abuts the end portion 18*b* of the guide hole 18. An electromagnetic repulsive force is generated very quickly upon the occurrence of a short-circuit current and therefore the contact separation is achieved before the automatic trip unit 8 is actuated, providing a high current limiting capability.

Immediately after the electromagnetic repulsive separation is achieved, the automatic trip unit 8 trips and rotates the first contact arm 14*a* to return the sliding pin 20 into the recessed portion 18*a* along the pin sliding surface 18*c* of the guide hole 18 after it has passed the position shown in FIG. 6 to take up the tripped position shown in FIG. 5. This is called the resetting of the contact arm assembly 14. At this time, the sliding pin 20 is moved along a pin sliding surface 19*a* of the elongated hole 19 while being biased by the tension spring 21 against the pin sliding surface 18*c* of the guide hole 18.

In the conventional multi-pole circuit interrupter as above described, the stopper 27 for limiting the movement of the second contact arm 14*b* extends from the cover 1*b* of the housing 1 for the side pole unit 3. Therefore, when the housing cover 1*b* is removed from the base 1*a* during assembly or inspection of the circuit interrupter, the stopper 27 is also removed and the second contact arm 14*b* can rotate beyond the normal stop position at which it is normally stopped during normal operation of the circuit interrupter. Thus, it is not possible to achieve inspection or assembly and adjustment of the circuit interrupter where the components are positioned in normal operating positions.

SUMMARY OF THE INVENTION

Accordingly, an object of the present invention is to provide a multi-pole circuit interrupter in which a stopper for the contact arm assembly is provided even when the cover is removed.

With the above objects in view, a multi-pole circuit interrupter of the present invention includes at least a first pole unit provided with an operating mechanism and a second pole unit provided with no operating mechanism, for interrupting current flowing therethrough by separating a movable contact from a stationary contact as a result of an electromagnetic repulsive force generated upon occurrence of a large overcurrent irrespective of an automatic trip operation of the operating mechanism. Each pole unit is provided with a movable contact arm assembly having a pair of first and second contact arm pivotally supported by a common pin, the first contact arms pivotally supported by a common pivot pin. The first contact arm in the first pole unit has an elongated guide hole extending in a direction of movement of the movable contact and is directly connected to the operating mechanism. The second arm in the second pole unit has an elongated hole extending substantially in a direction of extension thereof and is connected to the operating mechanism through a cross bar. A spring biased sliding pin is provided and extends through the elongated hole and the guide hole. A stopper is mounted to a base of the second pole unit for limiting movement of the second contact arm beyond a predetermined position.

BRIEF DESCRIPTION OF THE DRAWINGS

The present invention will become more readily apparent from the following detailed description of the preferred embodiment of the present invention taken in conjunction with the accompanying drawings, in which.

PREFERRED EMBODIMENTS OF THE INVENTION

Figure 1:
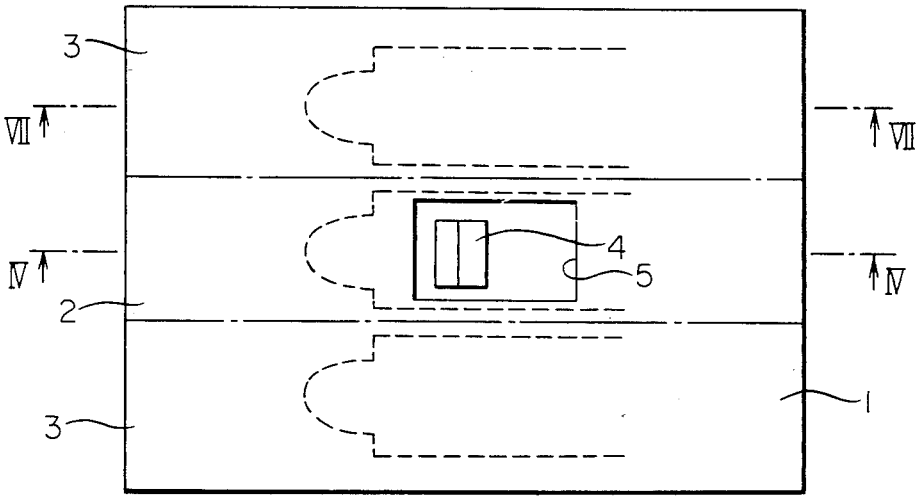
FIG. 1 PRIOR ART
FIG. 1 is a plan view of a conventional multi-pole circuit interrupter.
Figure 2:
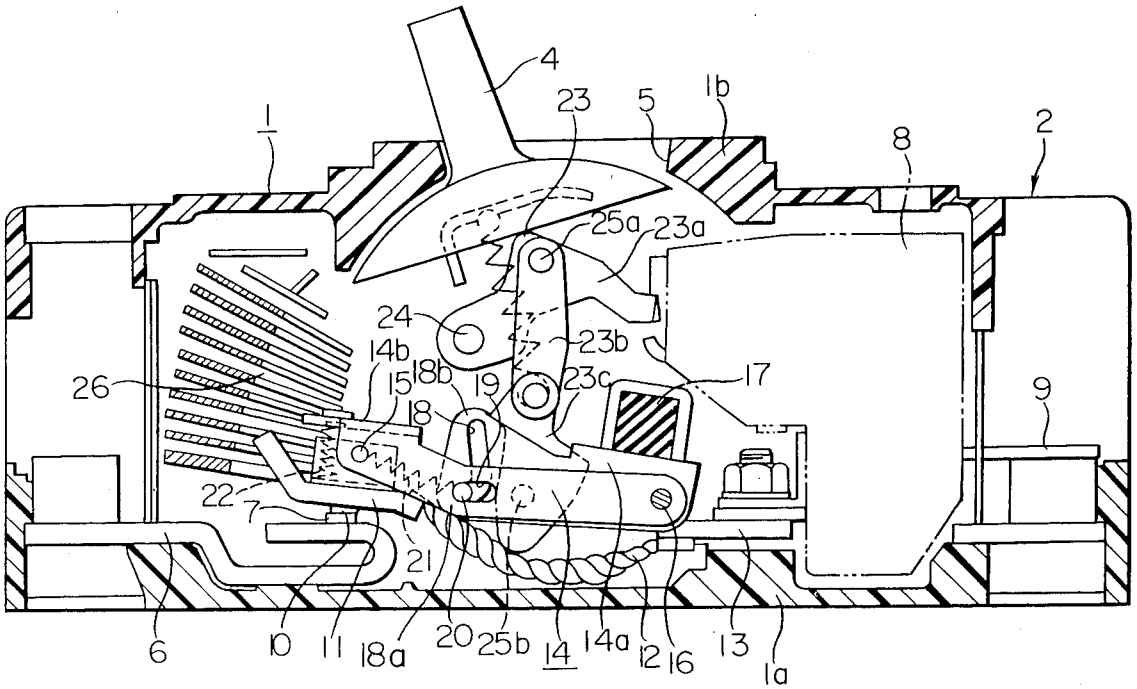
FIG. 2 PRIOR ART
FIG. 2 is an enlarged cross sectional view taken along line II—II of FIG. 1.
Figure 3:
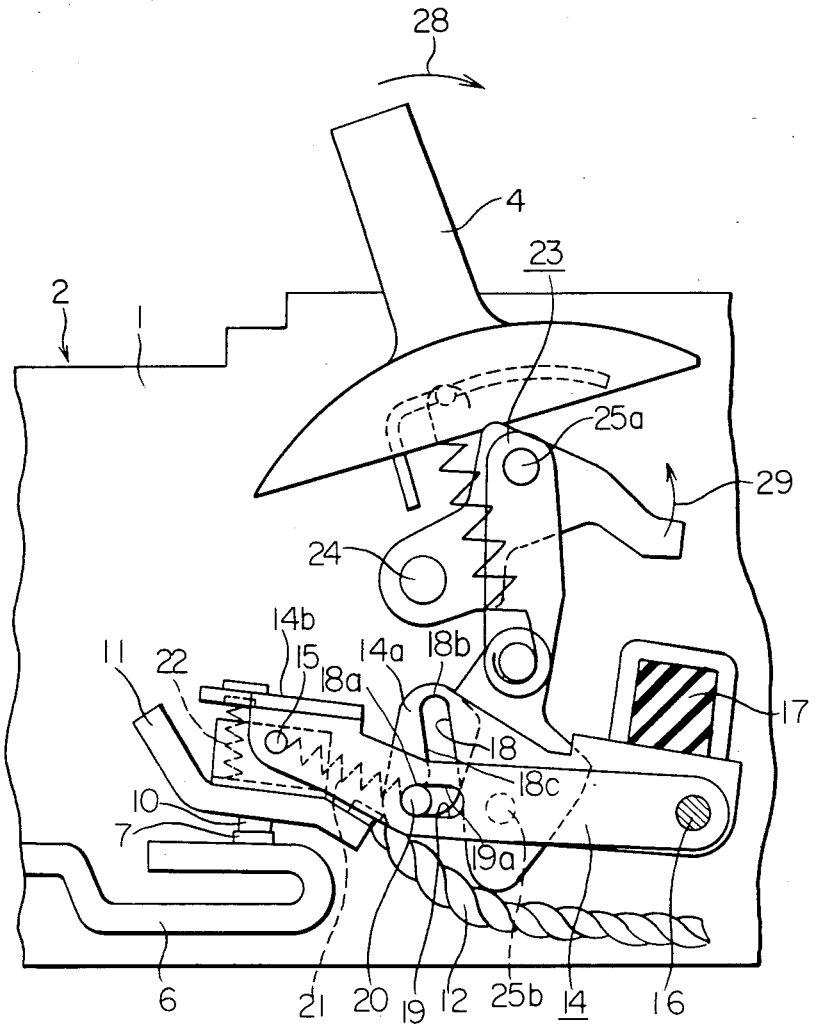
FIG. 3 PRIOR ART
FIG. 3 is a partial enlarged sectional view of FIG. 2 and showing the ON position.
Figure 4:
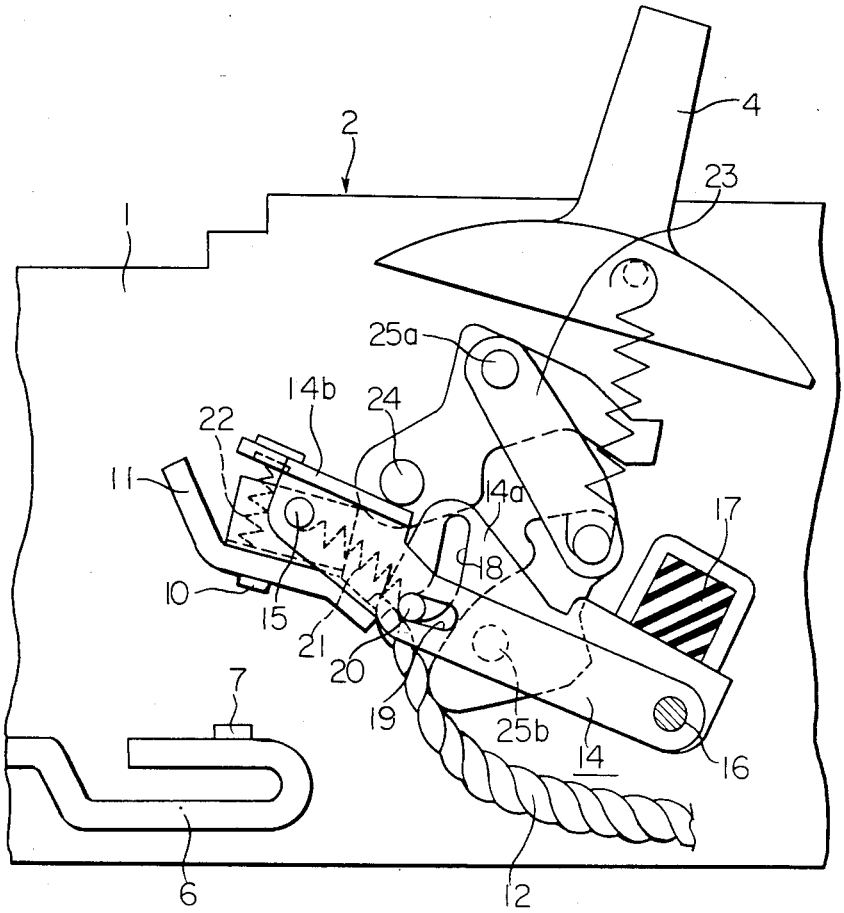
FIG. 4 PRIOR ART
FIG. 4 is a view similar to FIG. 3, but illustrating the OFF position.
Figure 5:
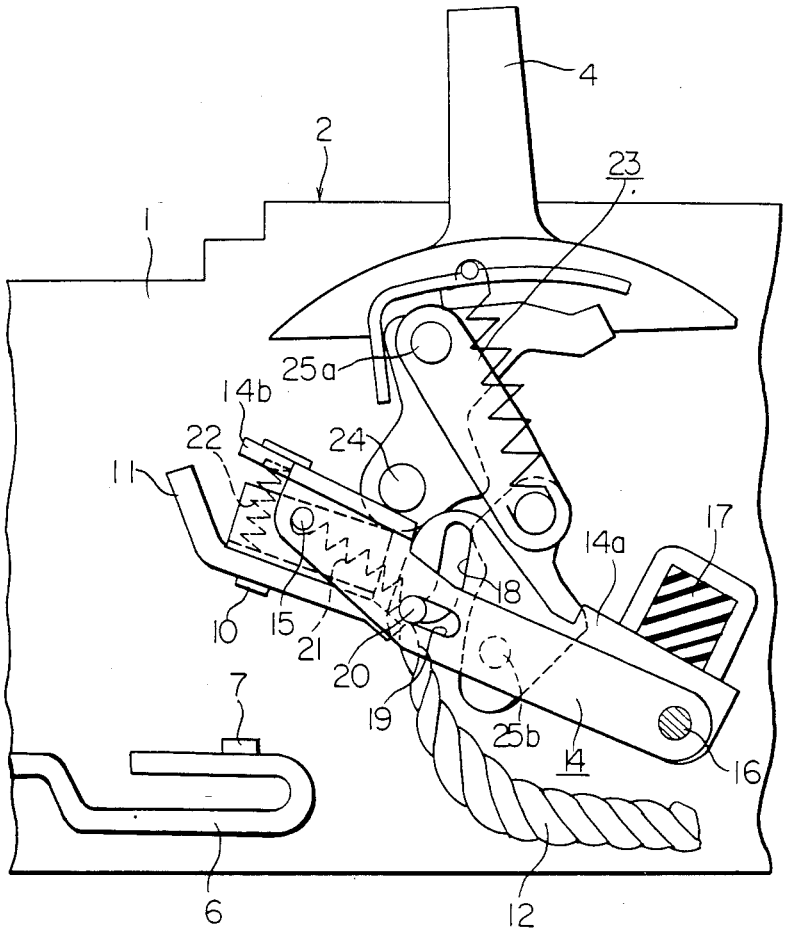
FIG. 5 PRIOR ART
FIG. 5 is a view similar to FIG. 3, but illustrating the TRIP position.
Figure 6:
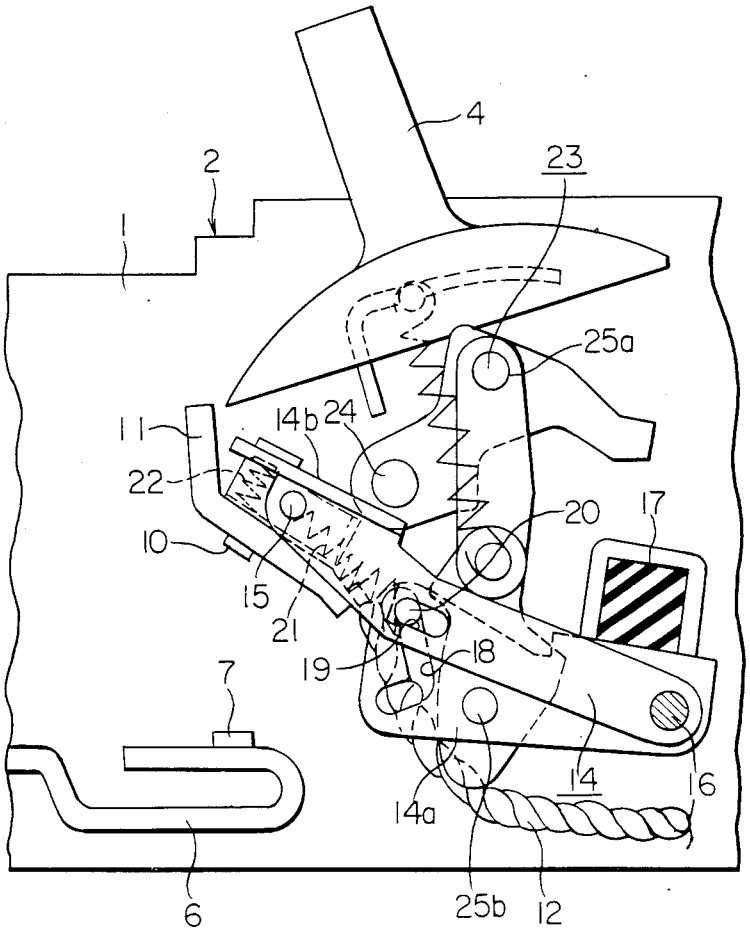
FIG. 6 PRIOR ART
FIG. 6 is a view similar to FIG. 3, but illustrating the electromagnetically operated position.
Figure 7:
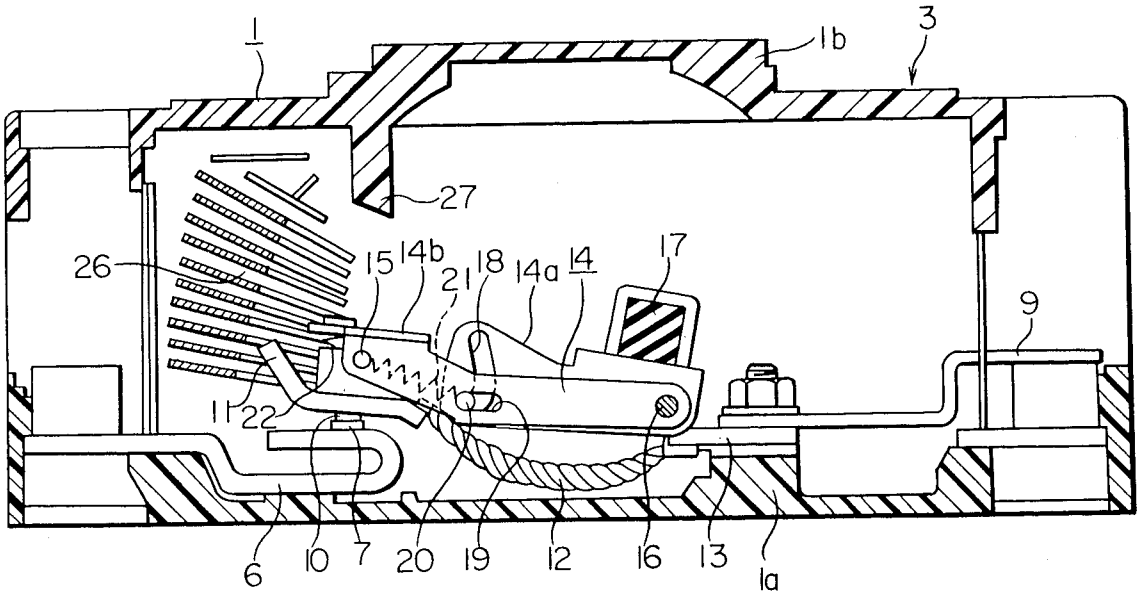
FIG. 7 PRIOR ART
FIG. 7 is an enlarged cross sectional view taken along line VII—VII of FIG. 1.
Figure 8:
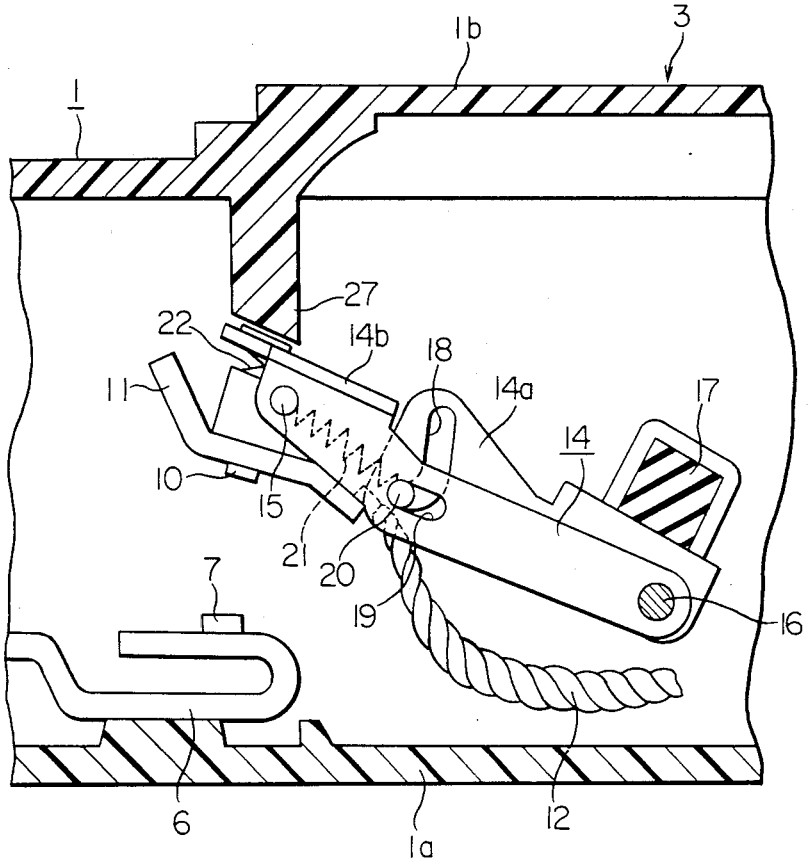
FIG. 8 PRIOR ART
FIG. 8 is an enlarged view of a portion of FIG. 7 and illustrating the OFF position.
Figure 9:
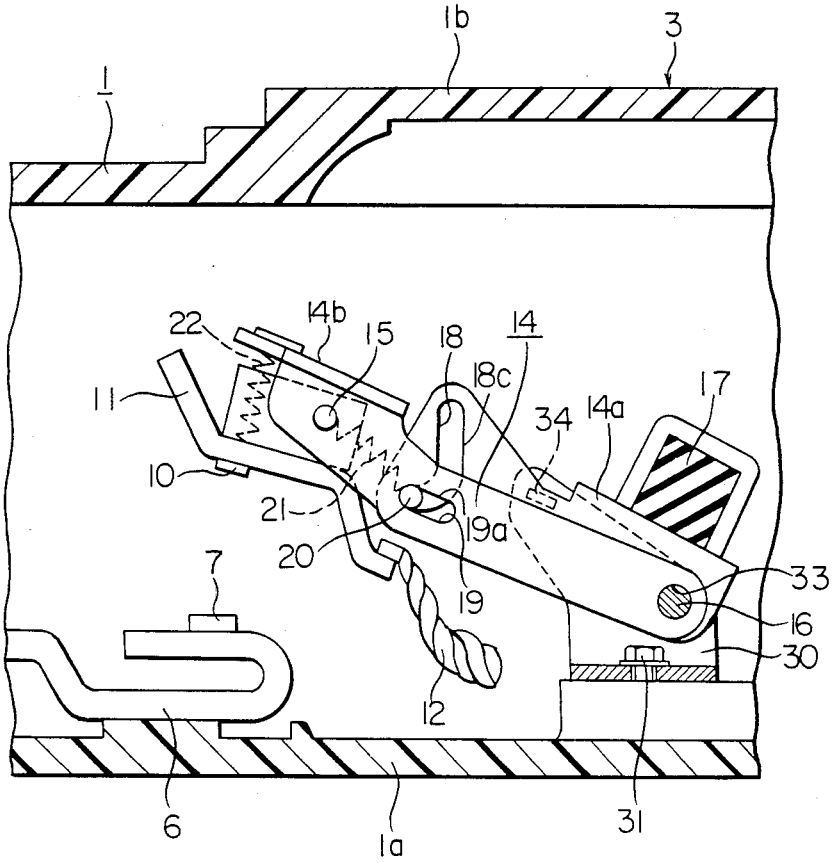
FIG. 9 is an enlarged view of a contact arm assembly of one embodiment of a circuit interrupter of the present invention.
Figure 10:
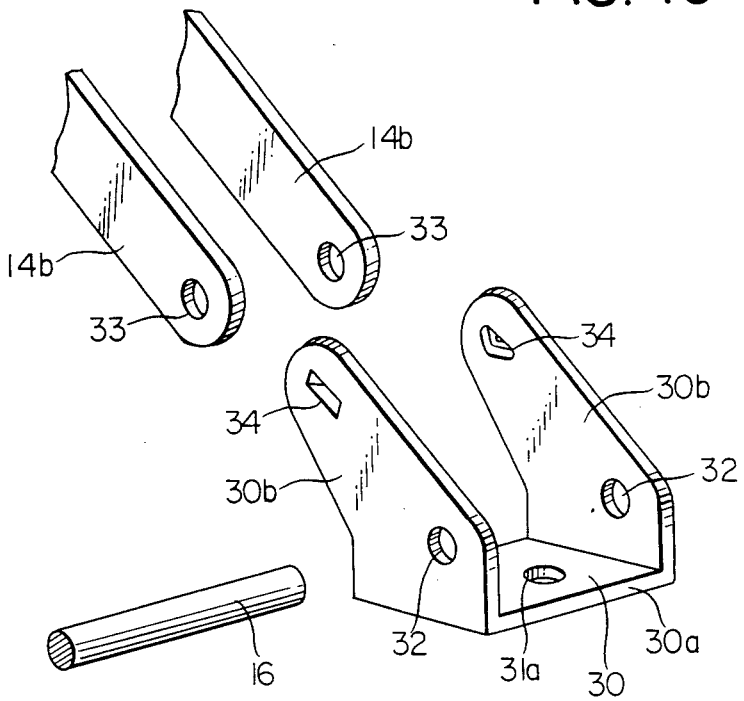
FIG. 10 is an exploded perspective view of the stopper arrangement for limiting the movement of the contact arm assembly.

FIG. 9 illustrates one embodiment of the contact arm assembly of a second pole unit in which no operating mechanism is provided in a fragmental enlarged view similar to FIG. 8 and illustrating the OFF position. FIG. 10 illustrates the main portion of the contact arm assembly shown in FIG. 9 in an exploded perspective view. The same reference numerals designate identical with or corresponding components to those used in the previous figures. In these figures, each pale unit of the circuit interrupter of the present invention comprises a support bracket 30 having a substantially U-shaped cross-section. A bottom portion or flat bight portion 30*a* of the "U" has through holes 31*a* (FIG. 10) so as to secure the support bracket 30 to the base 1*a* of the insulating housing 1 by screws 31 which extend through the through-holes 31*a*. Each of the parallel leg portions 30*b* of the "U" of the support bracket 30 has formed therein a hole 32 for receiving therein the opposite ends of the pivot pins 16 which extends through the holes 33 formed in the ends of the first and second contact arms 14*a* and 14*b* for allowing a pivotal movement about the pivot pin 16.

According to one embodiment of the present invention, each of the leg portions 30*b* of the support bracket 30 mounted in the second pole unit 3 that has no operating mechanism are provided with a stop 34 formed by pushing and projecting inwardly toward each other. The dimensions of the stops 34 are selected so that the stops can engage an upper edge of the second contact arm 14*b* and serve as stopping means for limiting the rotational movement of the second contact arm 14*b* beyond the stops 34.

While the number of the stops 34 in the illustrated embodiment is two, one for each leg portion 30*b* of the support bracket 30, only a single stop 34 provided on either one of the leg portions 30*b* may be sufficient. Also, the stops 34 may be directly mounted on the base 1*b*. Further, the stops 34 disposed in the second pole unit which has no operating mechanism may be used together with the stops in the first pole unit which has an operating mechanism. The stopper 27 mounted to the housing cover 1*b* may also be used together with the stops 34 of the present invention.

Figure 12:
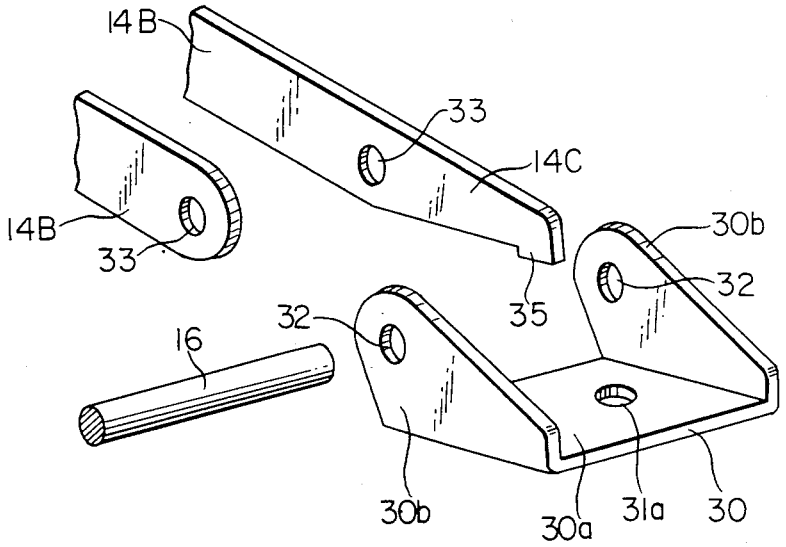
FIG. 12 is an exploded perspective view of the stopper arrangement for limiting the movement of the contact arm assembly.
Figure 11:
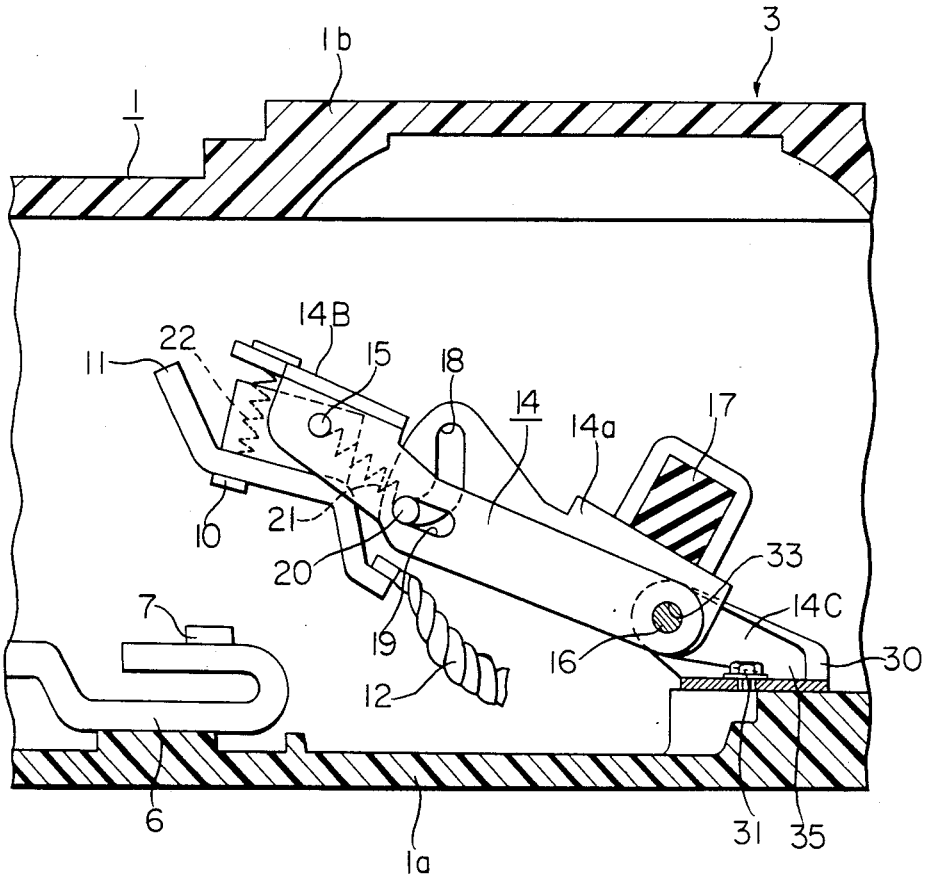
FIG. 11 is an enlarged view of a contact arm assembly of another embodiment of a circuit interrupter of the present invention.

According to another embodiment of the present invention shown in FIGS. 11 and 12, the second contact arm 14B has an extension 14C extending from the pivot end of the arm in the direction opposite to the general direction of extension of the arm. The tip of the extension 14C has an engagement tab 35 which engages the base portion 30*a* of the U-shaped support bracket 30 when the second contact arm 14B is rotated clockwise (as seen in FIG. 11) beyond a predetermined angle. Thus, the base portion 30*a* of the support bracket 30 serves as a stopper for the second contact arm 14B for limiting the rotation of the second contact arm 14B beyond a predetermined rotational angle.

While there is only one engagement tab 35 illustrated in the embodiment, two extensions 14C and two engagemnt tabs 35 may be used. Also, the engagement tabs 35 may be arranged to engage directly with the base 1*b* rather than with the support bracket 30. Further, the engagement tabs 35 disposed in the second pole unit without an operating mechanism may be used together with similar tabs in the first pole unit with an operating mechanism. Also the stopper 27 mounted to the housing cover 1*b* may also be used together with the stops 34 of the present invention.

With the above construction, since the stopper for limiting undesirable rotation of the contact arm assembly 14 is provided on the stationary structure mounted to the base 1*a* of the housing 1, the function of the stop is available even when the cover 1*b* of the housing is removed and the second contact arm 14*b* is prevented from rotating beyond the normal stop position. Thus, it is possible to achieve inspection or assembly and adjustment of the circuit interrupter when the components are positioned in their normal operating positions, enabling more precise adjustment.

What is claimed is:

1. A multi-pole circuit interrupter having a first pole unit provided with an operating mechanism and a second pole unit provided with no operating mechanism, said circuit interrupter interrupting current flowing therethrough by separating a movable contact from a stationary contact as a result of an electromagnetic repulsive force generated upon occurrence of a large overcurrent irrespective of an automatic trip operation of the operating mechanism, each of said first and second pole units comprising:

a base;

a substantially U-shaped support bracket secured to said base and having a leg portion;

a movable contact and a stationary contact;

a contact arm assembly for supporting the movable contact of the respective pole unit including a first contact arm and a second contact arm pivotally supported by a common pivot pin;

said first contact arm of said contact arm assembly in said first pole unit having an elongated guide hole extending in a direction of movement of the movable contact of said contact arm assembly and being directly connected to the operating mechanism of said first pole unit;

said first contact arm of said contact arm assembly in said second pole unit being connected to the operating mechanism of said first pole unit through a cross bar;

said second contact arm of said contact arm assembly in both said first and second pole units extending longitudinally and having an elongated hole extending substantially in the longitudinal direction of said second contact arm;

a spring-biased sliding pin extending through the elongated hole of said second contact arm and the elongated guide hole of said first arm of said contact arm assembly; and stopping means including a projection formed on an inner surface of said leg portion of said support bracket for engaging said second contact arm to prevent said second contact arm from moving beyond a predetermined position.

2. A multi-pole circuit interrupter having a first pole unit provided with an operating mechanism and a second pole unit provided with no operating mechanism, said circuit interrupter interrupting current flowing therethrough by separating a movable contact from a stationary contact as a result of an electromagnetic repulsive force generating upon occurrence of a large overcurrent irrespective of an automatic trip operation of the operating mechanism, each of said first and second pole units comprising:

a movable contact and a stationary contact;

a contact arm assembly for supporting the movable contact of the respective pole unit including a first contact arm and a second contact arm pivotally supported by a common pivot pin;

said first contact arm of said contact arm assembly in said first pole unit having an elongated guide hole extending in a direction of movement of the movable contact of said contact arm assembly and being directly connected to the operating mechanism of said first pole unit;

said first contact arm of said contact arm assembly in said second pole unit being connected to the operating mechanism of said first pole unit through a cross bar;

said second contact arm of said contact arm assembly in both said first and second pole units extending longitudinally and having an elongated hole extending substantially in the longitudinal direction of said second contact arm;

a spring-biased sliding pin extending through the elongated hole of said second contact arm and the elongated guide hole of said first arm of said contact arm assembly;

a substantially U-shaped support bracket having a base; and stopping means including an engagement tab projecting from said second contact arm to engage said base of said support bracket for limiting movement of said second contact arm beyond a predetermined position.

* * * * *